US006680463B2

(12) United States Patent
Honda

(10) Patent No.: US 6,680,463 B2
(45) Date of Patent: Jan. 20, 2004

(54) POWER SUPPLY CONTROL CIRCUIT AND COOKING DEVICE

(75) Inventor: Masateru Honda, Kadoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 19 days.

(21) Appl. No.: 10/157,996

(22) Filed: May 31, 2002

(65) Prior Publication Data

US 2003/0189035 A1 Oct. 9, 2003

(30) Foreign Application Priority Data

Jun. 1, 2001 (JP) ..... 2001-167383
Apr. 6, 2002 (JP) ..... 2002-127581

(51) Int. Cl.[7] ..... H05B 6/00; F24C 7/00

(52) U.S. Cl. ..... 219/501; 219/494; 219/702; 219/723; 323/371

(58) Field of Search ..... 219/501, 494, 219/702, 723; 323/371, 355, 220

(56) References Cited

U.S. PATENT DOCUMENTS 6,399,931 B1 * 6/2002 Kang et al. ..... 219/723
6,479,804 B2 * 11/2002 Cho et al. ..... 219/702

FOREIGN PATENT DOCUMENTS

| | | | |
|---|---|---|---|
| DE | 2312120 | * | 9/1974 |
| EP | 1195881 | * | 4/2002 |
| JP | 62-140391 | * | 6/1987 |
| JP | 10-261483 | | 9/1998 |
| JP | 11-287457 | | 10/1999 |
| JP | 2000-111059 | | 4/2000 |
| JP | 2000-111060 | | 4/2000 |

* cited by examiner

*Primary Examiner*—John A. Jeffery
(74) *Attorney, Agent, or Firm*—Birch, Stewart, Kolasch & Birch, LLP

(57) ABSTRACT

In the power supply control circuit, interposed between the power lines 1*a* and 1*b* is a serial circuit 21 constructed by connecting in series a radio interference suppression capacitor 2 for suppressing radio interference and a power supply holding switch 4. A node of the radio interference suppression capacitor 2 and the power supply holding switch 4 is connected via an auxiliary power line 1*d* to a primary side terminal 7*a* of a stepdown transformer 7, and another primary side terminal 7*b* of the stepdown transformer 7 is connected to a power line 1*b*. With the power supply control circuit, reduction of electric power consumption can be realized using a power supply holding switch with a small capacity.

16 Claims, 6 Drawing Sheets

POWER SUPPLY CONTROL CIRCUIT AND COOKING DEVICE

BACKGROUND OF THE INVENTION

1. Field of the Invention

The present invention relates to a power supply control circuit whose electric power consumption can be decreased by cutting off the power supply to a controller in a stand-by state, and to a cooking device having the power supply control circuit.

2. Description of Related Art

FIG. 1, which is a circuit diagram of the first example of prior art, shows a power supply control circuit provided in a cooking device which has a door. In FIG. 1, a commercial AC power source 1 is connected with power lines 1*a* and 1*b* for supplying electric power to a load 6 of the cooking device. Used as the load 6 is, for example, a high-frequency generating circuit when the cooking device is a microwave oven, or a heater when the cooking device is a thermal heating oven.

Connected in series to the power line 1*a* are a filter coil 9*a*, a starting power supplying switch 3 and a power supply holding switch 4 constituted of a relay switch, which is controlled to be in an on-state in response to power supply to a controller 8 for use of the cooking device and controlled to be in an off-state when the cooking device is in a nonuse state. The starting power supplying switch 3 is connected to a terminal of the load 6. The starting power supplying switch 3, which is a door switch operating in response to the opening/closure of a door (not shown) of the cooking device, has a common terminal 3*a* connected to the power line 1*a*, a closure terminal 3*b* which is connected to the common terminal 3*a* when the door is in a closed state, and an opening terminal 3*c* which is connected to the common terminal 3*a* when the door is in an open state. The closure terminal 3*b* is connected to the load 6. The opening terminal 3*c* is connected to the AC power source 1 via an auxiliary power line 1*c*.

Connected in series to the power line 1*b* are a filter coil 9*b* and a load exciting control relay switch 5 for controlling on/off of power supply from the AC power source 1 to the load 6. The load exciting control relay switch 5 is connected to the other terminal of the load 6.

Connected between the power lines 1*a* and 1*b* are a radio interference suppression capacitor 2 for suppressing radio interference and primary side terminals 7*a* and 7*b* of a stepdown transformer 7 which constitutes a control power supply unit. Moreover, radio interference suppression capacitors 12 and 13 (respectively having a capacity of 3,000 to 4,000 picofarad, for example) are respectively connected between the power line 1*a* and a grounded contact and between the power line 1*b* and the grounded contact.

Secondary side terminals 7*c* and 7*d* of the stepdown transformer 7 are connected via a rectification smoothing circuit (omitted in the figure) to a controller 8 which generates various kinds of control signals used for various kinds of control operations in the cooking device. A power supply holding control signal 4*s* outputted from the controller 8 controls the power supply holding switch 4 to be in an on-state. The power supply holding switch 4 is held in the on-state as long as the power supply holding control signal 4*s* is outputted. A load exciting control signal 5*s* outputted from the controller 8 controls on/off of a load exciting control relay switch 5.

The following description will explain the operations of the power supply control circuit. When the door is opened to place a material to be cooked in a cooking chamber for use of the cooking device, the common terminal 3*a* of the starting power supplying switch 3 constituted of a door switch is connected to the opening terminal 3*c*, and electric power is supplied from the AC power source 1 via the auxiliary power line 1*c* to the stepdown transformer 7. Upon the power supply to the stepdown transformer 7, the controller 8 is put into an operative state and outputs a power supply holding control signal 4*s*. The power supply holding control signal 4*s* turns on the power supply holding switch 4, and the power line 1*a* is connected to the AC power source 1 via the power supply holding switch 4. Since the power supply holding control signal 4*s* holds the power supply holding switch 4 in the on-state, power supply to the stepdown transformer 7 via the power lines 1*a* and 1*b* is maintained and thereby the controller 8 is kept in an operative state even when the door of the cooking device is closed again, the common terminal 3*a* of the starting power supplying switch 3 is connected to the closure terminal 3*b* again and power supply from the AC power source 1 via the opening terminal 3*c* is cut off.

Next, in response to an operator guidance through an operator control panel (not shown), the controller 8 outputs a load exciting control signal 5*s*. The load exciting control signal 5*s* turns on the load exciting control relay switch 5, electric power is supplied from the AC power source 1 to the load 6 via the power lines 1*a* and 1*b*, and a predetermined cooking operation is performed.

When the cooked material is taken out of the cooking chamber after the cooking operation finishes and it is judged that the cooking device is in a nonuse state (the judgment is performed based on, for example, whether opening/closure of the door is detected within a predetermined time after the detection of the opening/closure of the door at the end of the cooking operation), the output of the power supply holding control signal 4*s* stops, the power supply holding switch 4 is turned off, and thereby the electric power consumed while the controller 8 is in a stand-by state, i.e. since the controller 8 is put into a non-operative state until the cooking device is used next, is reduced.

FIG. 2, which is a circuit diagram of the second example of the prior art, shows a power supply control circuit provided in a cooking device which has a door. It should be noted that like codes are used to refer to like parts in this figure and FIG. 1, and detailed explanation thereof is omitted here. In FIG. 2, a door switch 31 is of a single junction type, and does not have the opening terminal 3*c* and the auxiliary power line 1*c* shown in FIG. 1. A push switch 11 as a starting power supplying switch is connected in parallel to the power supply holding switch 4. When the door of the cooking device is in a closed state, the door switch 31 is in an on-state, i.e., the terminal 31*a* connected to the power line 1*a* is connected with the terminal 31*b* connected to the load 6.

By pushing the push switch 11 for use of the cooking device, the push switch 11 is put into an on-state only while being pushed. When the push switch 11 is put into the on-state, the power line 1*a* is connected to the AC power source 1 and electric power is supplied to the stepdown transformer 7 via the power lines 1*a* and 1*b*. Upon the power supply to the stepdown transformer 7, the controller 8 is put into an operative state and outputs a power supply holding control signal 4*s*. The power supply holding control signal 4*s* turns on the power supply holding switch 4, and the power line 1*a* is connected to the AC power source 1 via the power supply holding switch 4.

The power supply holding control signal 4*s* holds the power supply holding switch 4 in the on-state even when the pushing operation against the push switch 11 is released and the push switch 11 is turned off. Consequently, power supply to the stepdown transformer 7 via the power lines 1*a* and 1*b* is maintained and the controller 8 is kept in the operative state.

FIG. 3, which is a circuit diagram of the third example of the prior art, shows a power supply control circuit provided in a cooking device which has a door. It should be noted that like codes are used to refer to like parts in this figure and FIGS. 1 and 2, and detailed explanation thereof is omitted here. In FIG. 3, the terminals of the power supply holding switch 4 are respectively connected to the common terminal 3*a* and the opening terminal 3*c* of the starting power supplying switch 3. The opening terminal 3*c* of the starting power supplying switch 3 is connected to the primary side terminal 7*a* of the stepdown transformer 7. In this circuit, since the radio interference suppression capacitor 2 is connected in parallel to the AC power source 1 (between the power lines 1*a* and 1*b*), it is necessary to keep the user, who pulls off a power source plug (not shown) to be connected to the AC power source 1, from receiving an electric shock by touching blades of the power source plug where voltage is generated due to the storage voltage generated by the charge in the radio interference suppression capacitor 2. For this purpose, a discharging resistor 10 is connected in parallel to the radio interference suppression capacitor 2. It is generally supposed to be necessary that the radio interference suppression capacitor 2 has a capacity of 0.1 microfarad or more in view of radio interference suppression. Connecting such a large capacitor to the AC power source 1, it is necessary to connect a discharging resistor 10 of approximately 1 megohm to meet Japanese safety standards, for example. When such a discharging resistor 10 is used, a total electric power consumption exceeds the negligible level even though the amount of the electric current in the stand-by state is minute.

When the door of the coking device is opened, the common terminal 3*a* of the starting power supplying switch 3 constituted of a door switch is connected to the opening terminal 3*c*, and electric power is supplied from the AC power source 1 via the power line 1*a* to the stepdown transformer 7. The further operations are the same as those of FIG. 1, and omitted here.

In the first example and the second example of the prior art, since the power supply holding switch is disposed in series to the power line, there arises a problem that it is necessary to employ a power supply holding switch (a relay switch) with a large current-carrying capacity which allows an electric current to flow, the electric current being as large as the load current which flows when the load is in an operative state.

In the third example of the prior art, in which a discharging resistor is connected in parallel to the radio interference suppression capacitor to discharge the charge in the radio interference suppression capacitor, there arises another problem that electric power consumption due to the discharging resistor is generated in the stand-by state though the amount of the power consumption is minute.

BRIEF SUMMARY OF THE INVENTION

The present invention has been made with the aim of solving the above problems, and it is an object thereof to provide a power supply control circuit having a serial circuit of a power supply holding switch and a radio interference suppression capacitor which is connected between power lines, with which a rated current of the power supply holding switch requires a small capacity by precluding the load current from flowing to the power supply holding switch, and moreover, stand-by electric power consumption due to the discharging resistor for discharging charge in the radio interference suppression capacitor can be decreased.

A power supply control circuit according to the present invention comprises: a control power supply unit to which electric power is supplied from power lines via a starting power supplying switch; a controller, to which electric power is supplied from the control power supply unit, for controlling power supply from a power source to a load; and a power supply holding switch, which is controlled to be in an on-state in response to the power supply to the controller, for maintaining the power supply from the power lines to the control power supply unit until the power supply holding switch is controlled to be in an off-state. In the power supply control circuit, a serial circuit of the power supply holding switch and the radio interference suppression capacitor is connected between the power lines, the node of the power supply holding switch and the radio interference suppression capacitor is connected to the node of the starting power supplying switch and the control power supply unit, and thereby electric power is supplied to the control power supply unit via the power supply holding switch.

Another power supply control circuit according to the present invention comprises: a control power supply unit to which electric power is supplied from power lines via a starting power supplying switch; a controller, to which electric power is supplied from the control power supply unit, for controlling power supply from a power source to a load; and a power supply holding switch, which is turned on in response to the power supply from the control power supply unit, for maintaining the power supply from the power lines to the control power supply unit until the power supply holding switch is controlled to be in an off-state by the controller. In the power supply control circuit, a serial circuit of the power supply holding switch and the radio interference suppression capacitor is connected between the power lines, the node of the power supply holding switch and the radio interference suppression capacitor is connected to the node of the starting power supplying switch and the control power supply unit, and thereby electric power is supplied to the control power supply unit via the power supply holding switch.

The starting power supplying switch is a switch which is turned on manually or automatically, such as a push switch which is held in an on-state only while, or at the moment, the user pushes the switch, and a door switch or a closure switch which is turned on in response to an opening operation of a door or a closure.

Employable as the power supply holding switch is a semiconductor switch such as a relay switch and a TRIAC (a triode AC switch).

In the power supply control circuit according to the present invention which is constructed to reduce the electric power consumption by cutting off the power supply to the controller in a stand-by state, the rated current of the power supply holding switch (a relay switch) for controlling the power supply to the controller requires a small capacity, and moreover, the discharging resistor which is necessary for the prior art to discharge the charge in the radio interference suppression capacitor is unnecessary. The reduction of the electric power consumption due to the discharging resistor and the employment of the power supply holding switch with a small capacity allow costs to be decreased.

The cooking device according to the present invention having a high-frequency generating circuit comprises the power supply control circuit according to the present invention which uses the high-frequency generating circuit as the load.

The invention can provide a cooking device comprising the power supply control circuit in which the rated current of the power supply holding switch (a relay switch) requires a small capacity, and moreover, the discharging resistor of the radio interference suppression capacitor which is necessary for the prior art is unnecessary. Consequently, it is possible to realize a cooking device of low electric power consumption and small cost.

The above and further objects and features of the invention will more fully be apparent from the following detailed description with accompanying drawings.

DETAILED DESCRIPTION OF THE INVENTION

The following description will explain the present invention in detail with reference to the drawings illustrating some embodiments thereof.

First Embodiment

Figure 4:
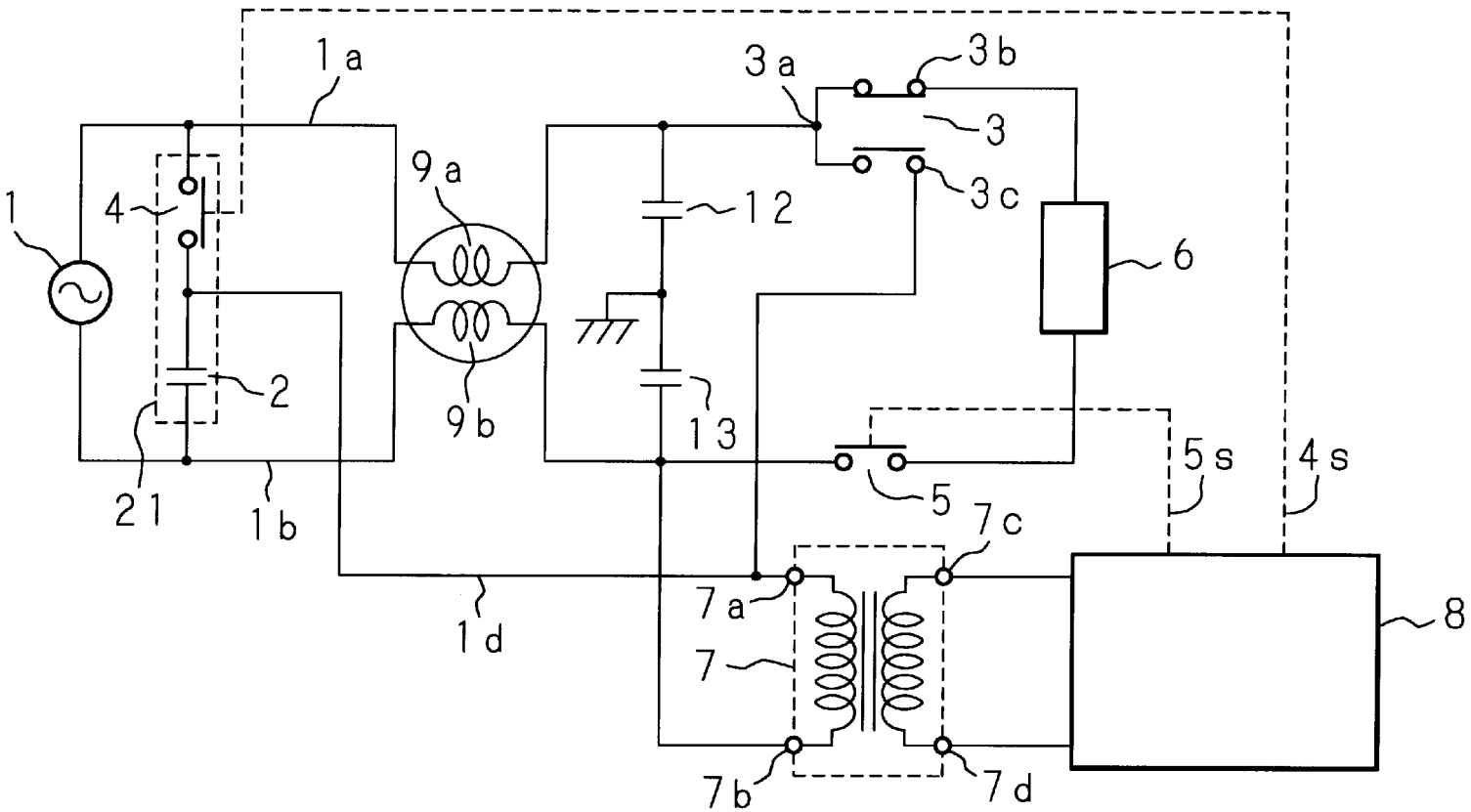
FIG. 4 is a circuit diagram showing First Embodiment of the present invention.

FIG. 4, which is a circuit diagram of the First Embodiment of the present invention, shows a power supply control circuit provided in a cooking device which has a door. In FIG. 4, a commercial AC power source 1 is connected with power lines 1*a* and 1*b* for supplying electric power to a load 6 of the cooking device. Used as the load 6 is, for example, a high-frequency generating circuit when the cooking device is a microwave oven, or a heater when the cooking device is a thermal heating oven. It should be noted that the power supply control circuit of the present invention is applicable to devices other than the cooking device whose door is opened and closed at the starting moment.

Connected in series to the power line 1*a* are a filter coil 9*a* and a starting power supplying switch 3. The starting power supplying switch 3 is connected to a terminal of the load 6. The starting power supplying switch 3, which is a door switch operating in response to the opening/closure of the door (not shown) of the cooking device, has a common terminal 3*a* connected to the power line 1*a*, a closure terminal 3*b* which is connected to the common terminal 3*a* when the door is in a closed state, and an opening terminal 3*c* which is connected to the common terminal 3*a* when the door is in an open state. The closure terminal 3*b* is connected to a terminal of the load 6. The opening terminal 3*c* is connected to a primary side terminal 7*a* of a stepdown transformer 7 which constitutes a control power supply unit. Another primary side terminal 7*b* of the stepdown transformer 7 is connected to the power line 1*b*.

Connected in series to the power line 1*b* are a filter coil 9*b* and a load exciting control relay switch 5 for controlling on/off of a power supply line from the AC power source 1 to the load 6. The load exciting control relay switch 5 is connected to the other terminal of the load 6.

Interposed between the power lines 1*a* and 1*b* is a serial circuit 21 constructed by connecting a radio interference suppression capacitor 2 (having a capacity of 2 microfarad, for example) for suppressing radio interference and a power supply holding switch 4. The power supply holding switch 4, which is constituted of an electromagnetic relay switch, is controlled to be in an on-state in response to power supply to an undermentioned controller 8, and controlled to be in an off-state when the cooking device is in a nonuse state. The node of the radio interference suppression capacitor 2 for suppressing radio interference and the power supply holding switch 4 is connected to the primary side terminal 7*a* of the stepdown transformer 7 (or the opening terminal 3*c* of the starting power supplying switch 3) via an auxiliary power line 1*d*. Radio interference suppression capacitors 12 and 13 (respectively having a capacity of 3,000 to 4,000 picofarad, for example) are respectively connected between the power line 1*a* and a grounded contact and between the power line 1*b* and the grounded contact.

Secondary side terminals 7*c* and 7*d* of the stepdown transformer 7 are connected to the controller 8 which generates various kinds of control signals used for various kinds of control operations in the cooking device. The stepdown transformer 7 which constitutes a control power supply unit supplies required control electric power to the controller 8 via a rectification smoothing circuit and a voltage stabilizer (omitted in the figure). A power supply holding control signal 4*s* outputted from the controller 8 controls the power supply holding switch 4 to be in an on-state. The power supply holding switch 4 is kept in the on-state as long as the power supply holding control signal 4*s* is outputted. A load exciting control signal 5*s* outputted from the controller 8 controls on/off of a load exciting control relay switch 5.

The starting power supplying switch 3 may be any switch which is turned on in response to an operation, such as a push switch which is held in an on-state only while the user pushes the switch, and a door switch which is turned on in response to an opening operation of the door. Employable as the power supply holding switch 4 is a semiconductor switch such as an electromagnetic relay switch and a TRIAC (a triode AC switch).

The following description will explain the operations of the power supply control circuit. When the door of the cooking device is opened, the common terminal 3*a* of the starting power supplying switch 3 is switched over from the closure terminal 3*b* to the opening terminal 3*c*, and electric power is supplied from the AC power source 1 to the stepdown transformer 7. Upon the power supply to the stepdown transformer 7, the controller 8 is put into an operative state and outputs a power supply holding control signal 4*s*. The power supply holding control signal 4*s* turns on the power supply holding switch 4, and the auxiliary power line 1*d* is connected to the AC power source 1 via the power supply holding switch 4. Since the power supply holding control signal 4*s* holds the power supply holding switch 4 in the on-state, power supply to the stepdown transformer 7 via the auxiliary power line 1*d* is maintained and thereby the controller 8 is kept in an operative state even when the door of the cooking device is closed, the common terminal 3*a* of the starting power supplying switch 3 is switched over tothe closure terminal 3*b* and power supply to the stepdown transformer 7 via the opening terminal 3*c* is cut off. The power supply holding switch 4 puts the radio interference suppression capacitor 2 in an active state, and moreover, functions as a switch for maintaining the power supply to the controller 8.

In response to an operator guidance through an operator control panel (not shown), the controller 8 outputs a load exciting control signal 5*s*. The load exciting control signal 5*s* turns on the load exciting control relay switch 5, electric power is supplied from the AC power source 1 to the load 6 via the power lines 1*a* and 1*b*, and a predetermined cooking operation is performed. When the cooked material is taken out of the cooking chamber after the cooking operation finishes and it is judged that the cooking device is in a nonuse state, the output of the power supply holding control signal 4*s* stops and the power supply holding switch 4 is turned off. Since the controller 8 is in a non-operative state while the cooking device is not used, the electric power consumed while the cooking device is in a stand-by state is reduced.

Since the serial circuit 21 composed of the radio interference suppression capacitor 2 for suppressing radio interference and the power supply holding switch 4 is connected between the power lines 1*a* and 1*b* in parallel to the load 6, load current which flows when the load is in an operative state does not flow into the power supply holding switch 4. To the power supply holding switch 4 flows only a charging current to the capacitor 2 and supply current to the stepdown transformer 7 for supplying control electric power to the controller 8, which are small electric current relatively to the load current. Consequently, the power supply holding switch 4 may be a switch with a small rated current.

Figure 1:
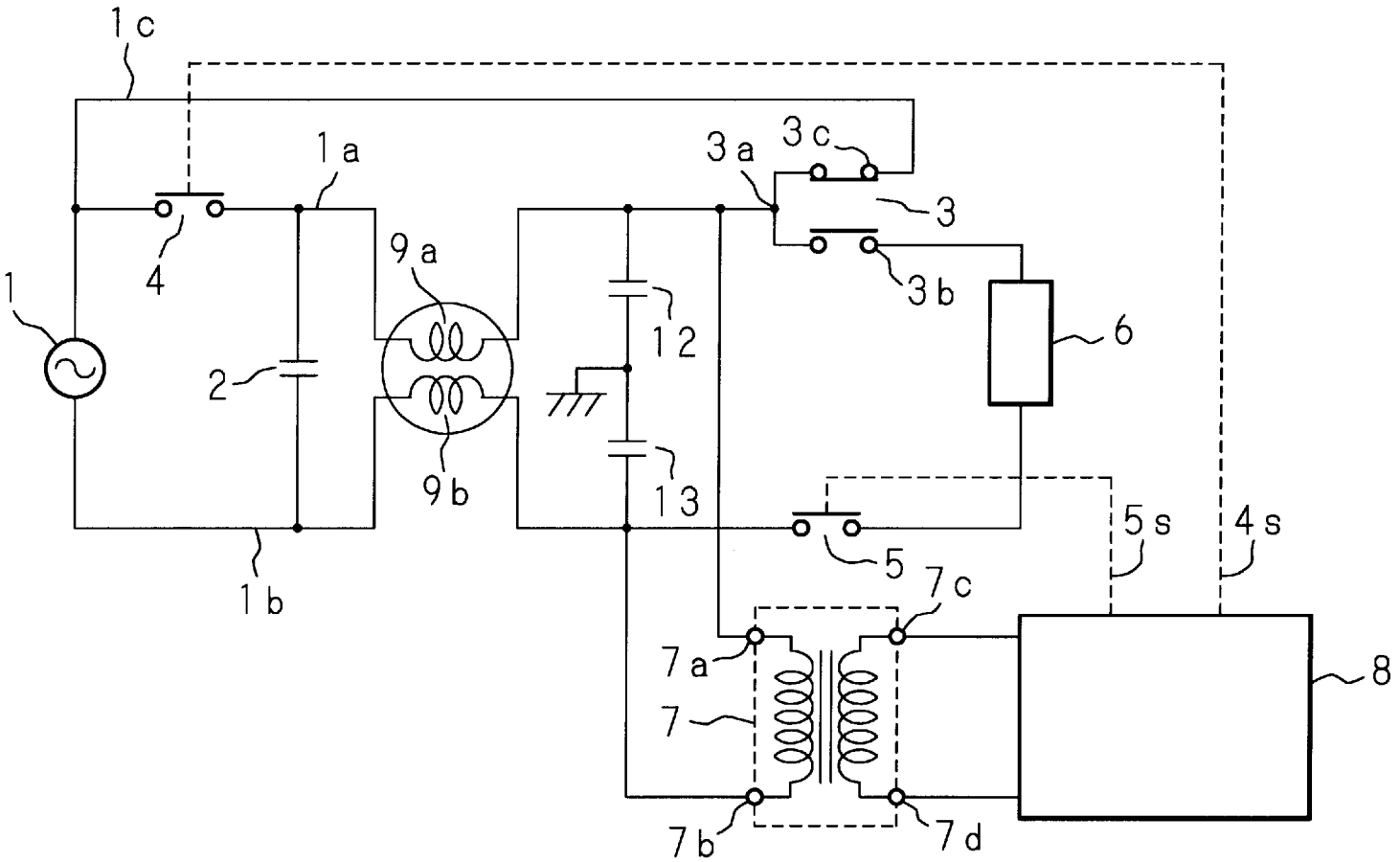
FIG. 1 PRIOR ART
FIG. 1 is a circuit diagram showing the first example of the prior art.
Figure 2:
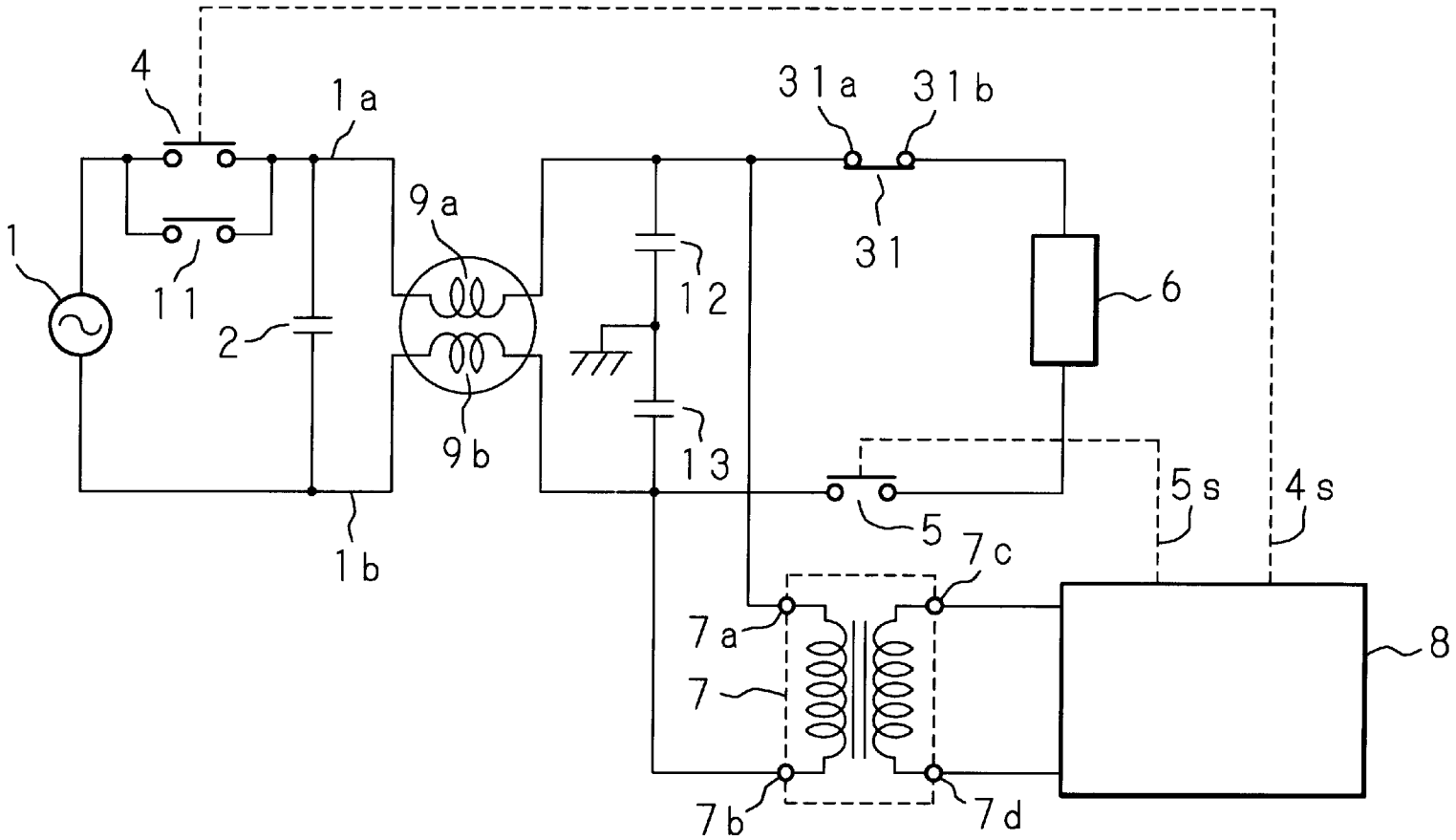
FIG. 2 PRIOR ART
FIG. 2 is a circuit diagram showing the second example of the prior art.
Figure 3:
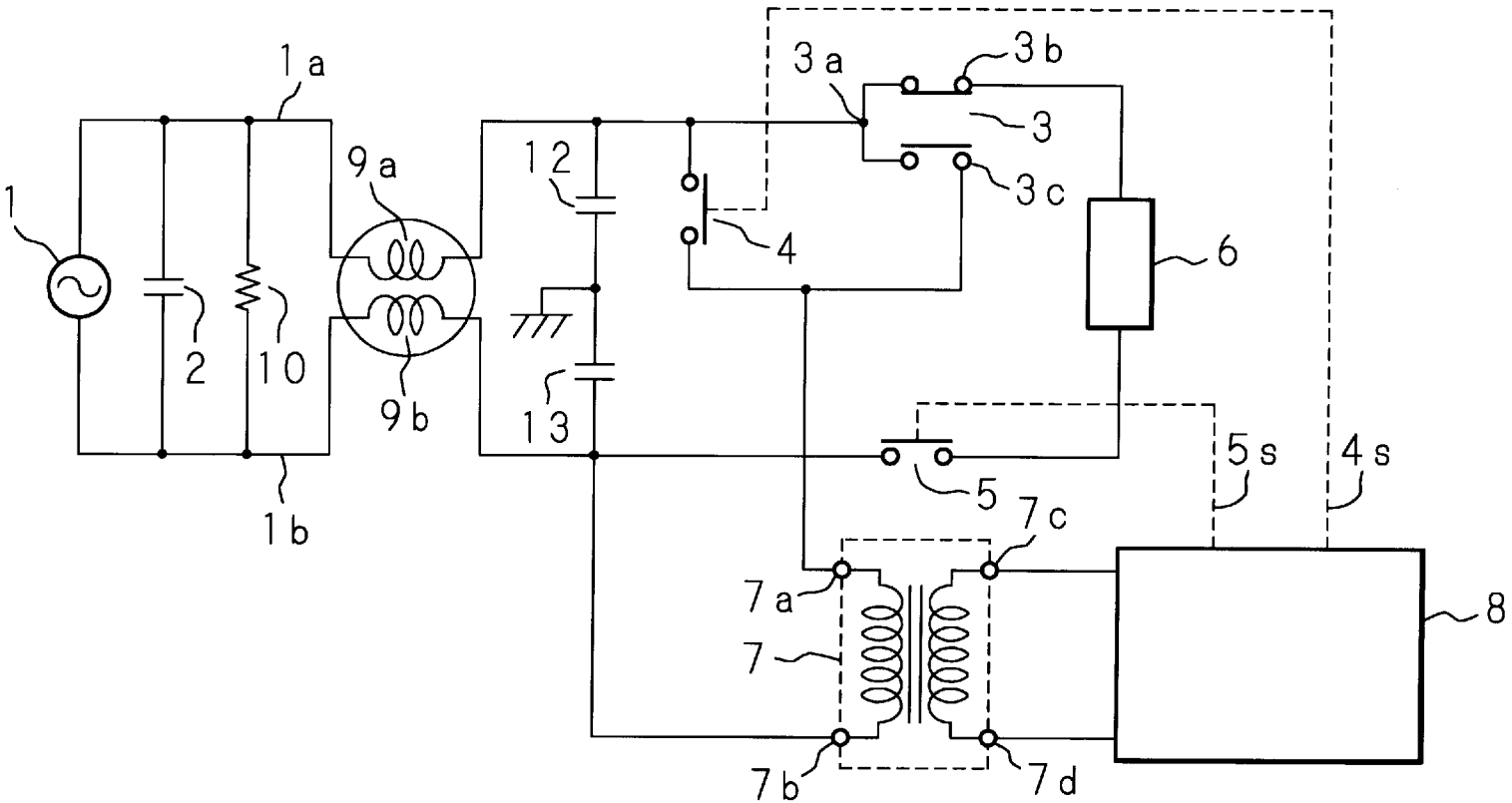
FIG. 3 PRIOR ART
FIG. 3 is a circuit diagram showing the third example of the prior art.

Moreover, since the power supply holding switch 4 is turned off when a power source plug (not shown) to be connected to the AC power source 1 is pulled off, there is no danger such that discharge voltage is generated between blades of the power source plug due to the storage voltage generated by the charge in the radio interference suppression capacitor 2. Consequently, the discharging resistor 10 (see FIG. 3) which is necessary for the prior art is unnecessary, and thereby costs can be decreased.

Second Embodiment

Figure 5:
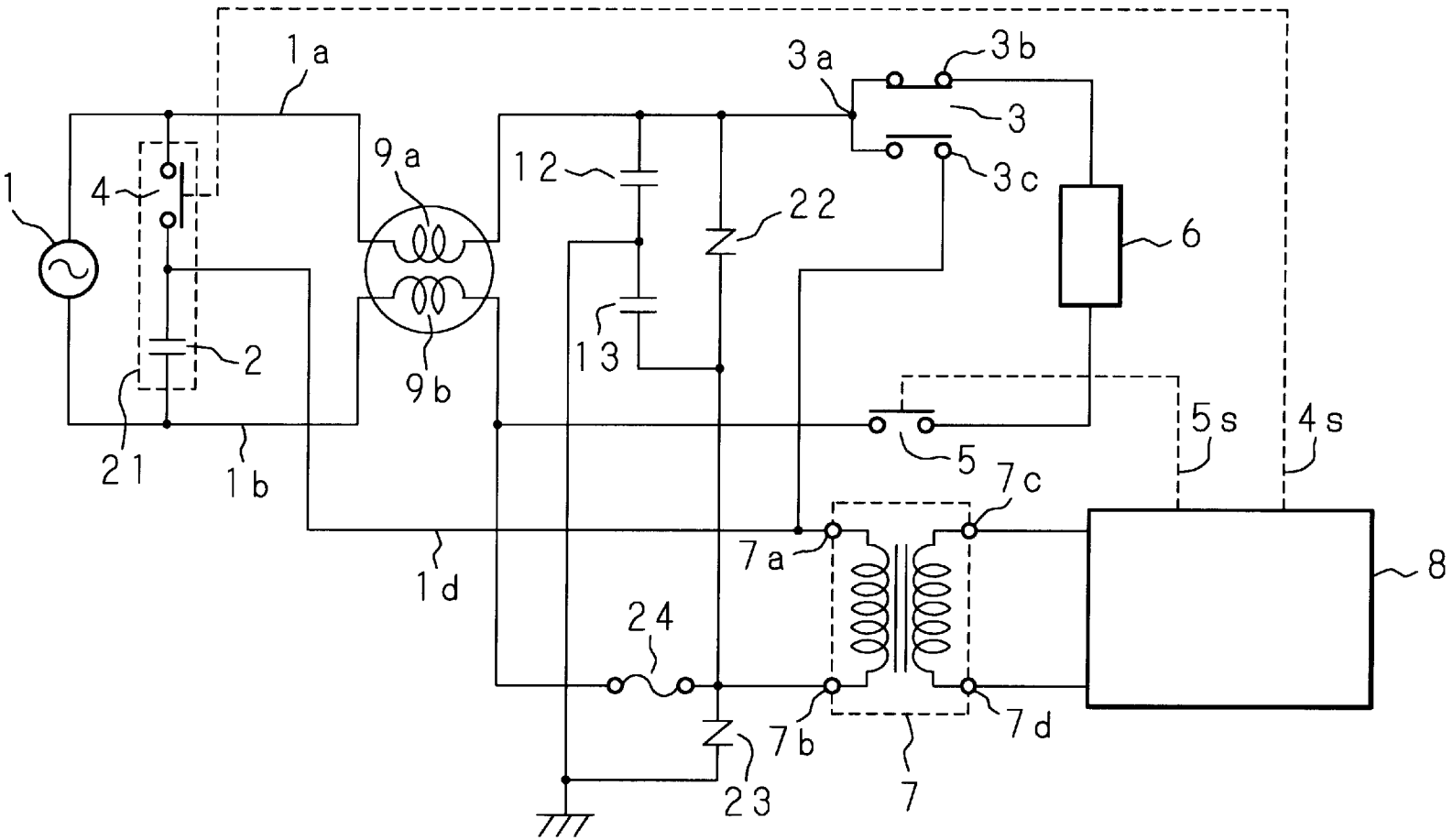
FIG. 5 is a circuit diagram showing Second Embodiment of the present invention.

FIG. 5, which is a circuit diagram of Second Embodiment of the present invention, shows a power supply control circuit in which a protective element for absorbing surge is connected in addition to the circuit diagram of FIG. 4, to enhance practicality. It should be noted that like codes are used to refer to like parts in this figure and FIG. 4, and detailed explanation thereof is omitted here. In FIG. 5, a surge absorber 22, constituted of a varistor for example, is connected in parallel to the radio interference suppression capacitors 12 and 13. A terminal of the surge absorber 22 is connected to the power line 1*a*, and the other terminal to the primary side terminal 7*b* of the stepdown transformer 7. To the primary side terminal 7*b* of the stepdown transformer 7, a terminal of another surge absorber 23 is further connected, and the other terminal of the surge absorber 23 is grounded. The primary side terminal 7*b* of the stepdown transformer 7 is connected to a terminal of a fuse 24, and the other terminal of the fuse 24 is connected to the power line 1*b*.

Also in the present embodiment, the discharging resistor 10 (see FIG. 3) which is necessary for the prior art is unnecessary, the power supply holding switch 4 (a relay switch) with a small capacity can be employed, and thereby costs can be decreased.

Third Embodiment

Figure 6:
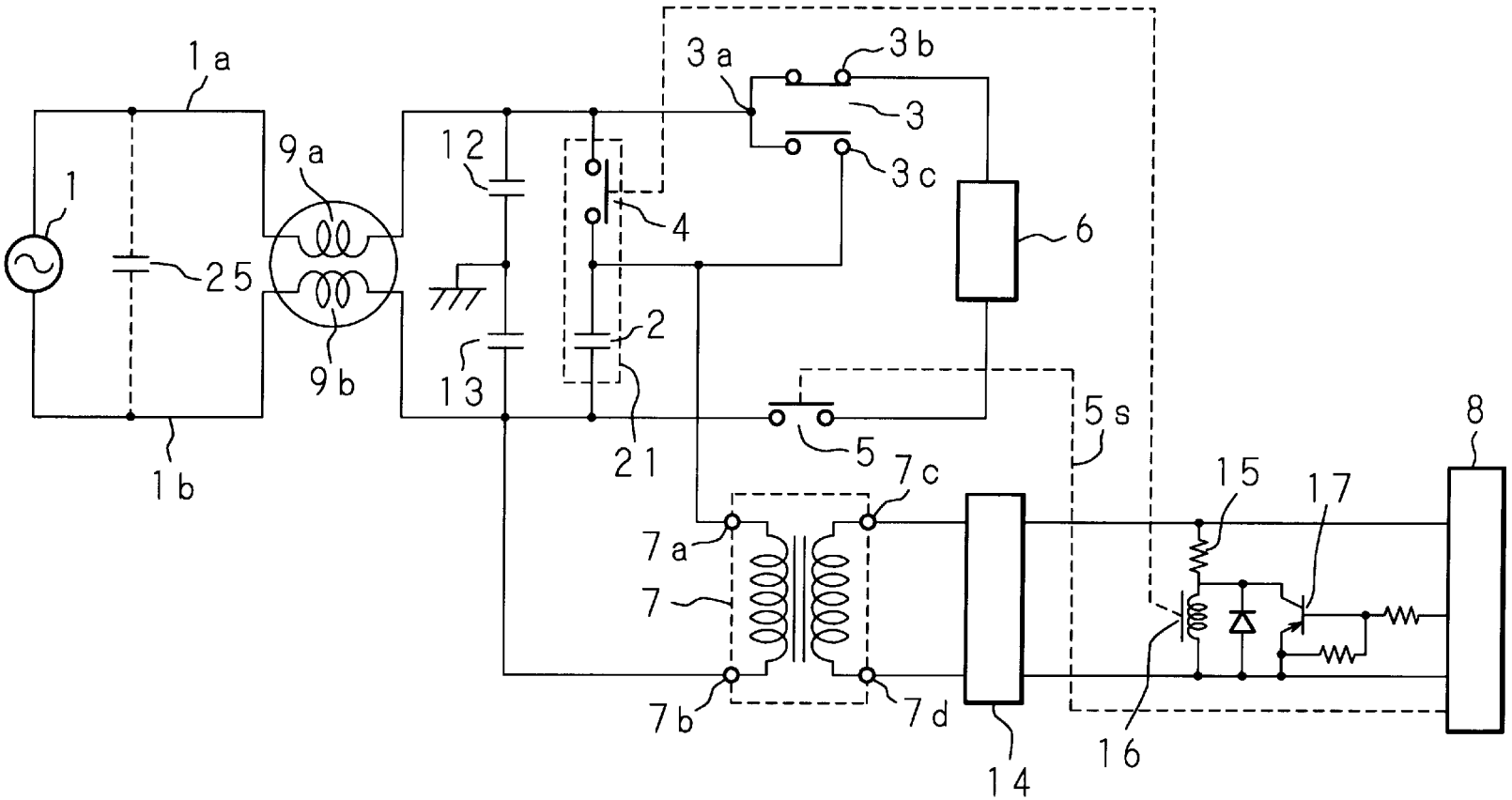
FIG. 6 is a circuit diagram showing Third Embodiment of the present invention.

FIG. 6 is a circuit diagram showing Third Embodiment of the present invention. It should be noted that like codes are used to refer to like parts in this figure and FIGS. 4 and 5, and detailed explanation thereof is omitted here. In FIG. 6, terminals of the power supply holding switch 4 is respectively connected to the common terminal 3*a* and the opening terminal 3*c* of the starting power supplying switch 3. The opening terminal 3*c* is connected to the primary side terminal 7*a* of the stepdown transformer 7. The radio interference suppression capacitor 2 is connected between the node of the power supply holding switch 4 and the opening terminal 3*c* and the power line 1*b*.

The power supply holding switch 4, which is constituted of a relay switch, is turned on/off by a relay coil 16 which is connected, in series with a resistor 15, to a control power supply via a rectification smoothing circuit 14 connected to the secondary side terminals 7*c* and 7*d* of the stepdown transformer 7. A transistor 17 and a diode are connected in parallel to the relay coil 16. As a result, the controller 8 controls the on/off of the transistor 17.

The power supply holding switch 4 is turned on when electric power is supplied to the control power supply unit composed of the stepdown transformer 7 and the rectification smoothing circuit 14, to thereby excite the relay coil 16 via the resistor 15. When the controller 8 judges that the cooking device is in a nonuse state and outputs an ON signal to a base of the transistor 17, the transistor 17 is turned on, and electric current flows from the collector to the emitter. Since a path for electric current is formed through the resistor 15 and the transistor 17, little electric current flows into the relay coil 16 and the power supply holding switch 4 is turned off.

Being constructed to preclude the controller 8 from turning on the power supply holding switch 4, this circuit saves the time which is taken for turning on the power supply holding switch 4 in First Embodiment and Second Embodiment. The saved time corresponds to the time which passes since the controller 8 starts operations till the controller 8 outputs the power supply holding control signal 4*s*. The present embodiment is therefore suitable for a case where a push switch is employed as the starting power supplying switch 3.

Also in the present embodiment, the discharging resistor which is necessary for the prior art is unnecessary. Moreover, like First Embodiment and Second Embodiment, the power supply holding switch 4 (a relay switch) with a small charging current can be employed.

It should be noted that there are instances where radio interference cannot be absorbed enough since the radio interference suppression capacitor 2 is placed far from the AC power source 1. In such an instance, another radio interference suppression capacitor 25 with a small capacity may be further connected. By connecting a radio interference suppression capacitor 2 with a capacity of 2.2 microfarad, for example, the capacity of the radio interference suppression capacitor 25 can be lower than 0.1 microfarad, and it is unnecessary to connect any discharging resistor.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A power supply control circuit comprising:

a control power supply unit to which electric power is supplied from power lines via a starting power supplying switch;

a controller, to which electric power is supplied from the control power supply unit, for controlling power supply from a power source to a load; and a serial circuit of a power supply holding switch and a radio interference suppression capacitor, which is connected between the power lines, the power supply holding switch being controlled to be in an on-state in response to the power supply to the controller, and maintaining the power supply from the power lines to the control power supply unit until the power supply holding switch is controlled to be in an off-state, wherein a node of the power supply holding switch and the radio interference suppression capacitor is connected to a node of the starting power supplying switch and the control power supply unit, whereby electric power is supplied to the control power supply unit via the power supply holding switch.

2. The power supply control circuit according to claim 1, wherein a filter coil is interposed in series between the power lines and the serial circuit is connected on one side of the filter coil, which side is nearer to the load.

3. The power supply control circuit according to claim 1, wherein the starting power supplying switch is a push switch which is held in an on-state only while being pushed.

4. The power supply control circuit according to claim 1, which is provided in a device having a door to be opened and closed for use, wherein the starting power supplying switch is a door switch which is turned on in response to an opening operation of the door.

5. A power supply control circuit comprising:

a control power supply unit to which electric power is supplied from power lines via a starting power supplying switch;

a controller, to which electric power is supplied from the control power supply unit, for controlling power supply from a power source to a load; and a serial circuit of a power supply holding switch and a radio interference suppression capacitor, which is connected between the power lines, the power supply holding switch being turned on in response to the power supply from the control power supply unit, and maintaining the power supply from the power lines to the control power supply unit until the power supply holding switch is controlled to be in an off-state by the controller, wherein a node of the power supply holding switch and the radio interference suppression capacitor is connected to a node of the starting power supplying switch and the control power supply unit, whereby electric power is supplied to the control power supply unit via the power supply holding switch.

6. The power supply control circuit according to claim 5, wherein a filter coil is interposed in series between the power lines and the serial circuit is connected on one side of the filter coil, which side is nearer to the load.

7. The power supply control circuit according to claim 5, wherein the starting power supplying switch is a push switch which is held in an on-state only while being pushed.

8. The power supply control circuit according to claim 5, which is provided in a device having a door to be opened and closed for use, wherein the starting power supplying switch is a door switch which is turned on in response to an opening operation of the door.

9. A cooking device having a power supply control circuit which comprises:

a control power supply unit to which electric power is supplied from power lines via a starting power supplying switch;

a controller, to which electric power is supplied from the control power supply unit, for controlling power supply from a power source to a load which is a high-frequency generating circuit; and a serial circuit of a power supply holding switch and a radio interference suppression capacitor, which is connected between the power lines, the power supply holding switch being controlled to be in an on-state in response to the power supply to the controller, and maintaining the power supply from the power lines to the control power supply unit until the power supply holding switch is controlled to be in an off-state, wherein a node of the power supply holding switch and the radio interference suppression capacitor is connected to a node of the starting power supplying switch and the control power supply unit, whereby electric power is supplied to the control power supply unit via the power supply holding switch.

10. The cooking device according to claim 9, wherein a filter coil is interposed in series between the power lines and the serial circuit is connected on one side of the filter coil, which side is nearer to the load.

11. The cooking device according to claim 9, wherein the starting power supplying switch is a push switch which is held in an on-state only while being pushed.

12. The cooking device according to claim 9, which has a door to be opened and closed for use, wherein the starting power supplying switch is a door switch which is turned on in response to an opening operation of the door.

13. A cooking device having a power supply control circuit which comprises:

a control power supply unit to which electric power is supplied from power lines via a starting power supplying switch;

a controller, to which electric power is supplied from the control power supply unit, for controlling power supply from a power source to a load which is a high-frequency generating circuit; and a serial circuit of a power supply holding switch and a radio interference suppression capacitor, which is connected between the power lines, the power supply holding switch being turned on in response to the power supply from the control power supply unit, and maintaining the power supply from the power lines to the control power supply unit until the power supply holding switch is controlled to be in an off-state by the controller, wherein a node of the power supply holding switch and the radio interference suppression capacitor is connected to a node of the starting power supplying switch and the control power supply unit, whereby electric power is supplied to the control power supply unit via the power supply holding switch.

14. The cooking device according to claim 13, wherein a filter coil is interposed in series between the power lines and the serial circuit is connected on one side of the filter coil, which side is nearer to the load.

15. The cooking device according to claim 13, wherein the starting power supplying switch is a push switch which is held in an on-state only while being pushed.

16. The cooking device according to claim 13, which has a door to be opened and closed for use, wherein the starting power supplying switch is a door switch which is turned on in response to an opening operation of the door.

* * * * *